US005118391A

United States Patent [19]

Matuschczyk et al.

[11] Patent Number: 5,118,391

[45] Date of Patent: Jun. 2, 1992

[54] PRESS BLANKET FOR A PRESSING DEVICE

[75] Inventors: Uwe Matuschczyk, Geislingen; Karl Steiner, Herbrechtingen; Harald Aufrecht, Aalen; Christian Schiel, Heidenheim, all of Fed. Rep. of Germany

[73] Assignee: J. M. Voith GmbH, Fed. Rep. of Germany

[21] Appl. No.: 730,486

[22] Filed: Jul. 16, 1991

[30] Foreign Application Priority Data

Jul. 18, 1990 [DE] Fed. Rep. of Germany ..... 4022800

[51] Int. Cl.[5] ..... D21F 3/02

[52] U.S. Cl. ..... 162/358; 162/361; 198/847; 428/295

[58] Field of Search ..... 162/358, 361; 198/847; 428/113, 259, 295

[56] References Cited

U.S. PATENT DOCUMENTS 4,552,620 11/1985 Adams ..... 162/358
4,880,501 11/1989 Schiel ..... 162/358
4,923,570 5/1990 Steiner et al. ..... 162/358
5,062,924 11/1991 McCarten et al. ..... 162/358

*Primary Examiner*—Karen M. Hastings

*Attorney, Agent, or Firm*—Ostrolenk, Faber, Gerb & Soffen

[57] ABSTRACT

A press blanket for a press device in a paper making machine, or the like, is formed of an elastomeric blanket material and fully embedded layers of reinforcement threads. The radially inner layer is formed of longitudinal threads which extend parallel to the axis of the press blanket. The radially outer layer is formed of circumferential threads which are wound in the direction of blanket motion and are wound generally helically. The threads are fully surrounded by the layer of elastomeric material which is of homogeneous, that is formed from a single pouring. The circumferential threads have a diameter of at most 1/500 of the outside diameter of the fully rounded press blanket. In a unit area of the press blanket, the tensile strength of the circumferential threads is at least 40% greater than the tensile strength of the longitudinal threads. An apparatus for forming such a press blanket includes a rotatable pouring cylinder on which the longitudinal threads are supported, an elastomeric material pouring nozzle which moves longitudinally over the pouring cylinder and an unwinding device for delivering the circumferential threads in a helical manner and located just after the pouring nozzle above the pouring cylinder.

12 Claims, 3 Drawing Sheets

PRESS BLANKET FOR A PRESSING DEVICE

The present invention relates to a press shell or blanket for a pressing device in a press section, particularly for removing water from and/or for smoothing a web of material, for instance, a paper web.

One such press blanket is disclosed in International Application WO 88/08897 which corresponds to pending U.S. application Ser. No. 299,829, filed Jan. 5, 1989 and to Canadian Application No. 570,468, filed Jun. 27, 1988. In this press blanket, the reinforcement threads do not have the form of a weave, as contrasted with the press blanket of U.S. Pat. No. 4,552,620. Instead, all of those threads lie relatively precisely parallel to the outer surfaces of the press blanket within the elastomeric material of the blanket. The reinforcement threads are arranged in two layers, with the longitudinal threads forming an inner layer and the circumferential threads forming an outer layer. The circumferential threads are wound either in the manner of a single start helix or a multiple start helix into the press blanket. Another feature of the known press blanket, as well as of the press blanket of the present invention, is that the layer of elastomeric material is formed from a single pouring. It is thus completely homogeneous, although it surrounds the reinforcement threads on all sides. As a result, the reinforcement threads are at no point directly at an outer surface of the press blanket and they do not extend anywhere out of the outer surface, as they do, for instance in FIGS. 2 and 3 of U.S. Pat. No. 4,552,620.

This type of press blankets is subjected to high stresses in operation. As can be noted from FIG. 1 of WO 88/08897 or from FIG. 5 of U.S. Pat. No. 4,552,620, a press blanket is subjected to high compression and flexing stresses as it passes through the press zone of the pressing device. When the press blanket is developed as a tubular roll blanket, which is closed at both ends, e.g. by attachment of the tubular roll to blanket support disks, there is also a tensile stress on the blanket as a result of the internal pressure inside the closed tube. The attachment of the lateral ends of the press blanket to the blanket support disks also prevents the ends of the press blanket from following the possible expansion of the press blanket in the circumferential direction. This requires that the press blanket be of extremely high tensile strength in the circumferential direction in order that its stretchability in the circumferential direction be as small as possible.

Additional stressing of the known tubular press blanket is known from U.S. Pat. No. 4,923,570, particularly FIG. 2. The normal path of rotation of the press blanket is at least approximately circular. Upon its entrance into the pressing zone, the press blanket must be deflected relatively sharply. The same is true upon its emergence from the press zone.

All of the above described stresses reduce the life of the press blanket.

SUMMARY OF THE INVENTION

The object of the present invention is to provide a press blanket which is of longer life than prior press blankets.

A press blanket for a press device in a paper making machine, or the like, is formed of an elastomeric blanket material containing fully embedded layers of reinforcement threads. The press blanket is in a tubular shape, an endless blanket that can assume a round shape. The radially inner reinforcement thread layer is formed of longitudinal threads which extend parallel to the axis of the press blanket. The radially outer reinforcement thread layer is formed of circumferential threads which are wound in the direction of blanket motion and are wound generally helically. All of the threads are fully surrounded by the layer of elastomeric material which is homogeneous, that is it is formed from a single pouring. In one preferred embodiment, the circumferential threads have a diameter of at most 1/500 of the outside diameter of the fully rounded press blanket. In any selected unit area of the press blanket, the sum of all thread cross sections of the circumferential threads is at least 50% greater than the sum of all thread cross sections of the longitudinal threads.

By the present invention, it is possible to simultaneously satisfy two contrary requirements, to provide the highest possible tensile strength, and thus very little stretchability, in the circumferential direction and to impart to the press blanket in the circumferential direction a "flexural softness" which is substantially better than heretofore. This makes it possible to substantially to reduce the stresses on the press blanket due to the relatively sharp deflections upon its entrance into and emergence from the pressing zone.

The use in accordance with the invention of extremely thin circumferential threads, with a diameter that is on the order of magnitude of 0.4 to 1 mm, provides greater flexural softness. This enables substantial reduction of the overall thickness of the press blanket, as compared with previous blankets. The overall thickness may, for instance, be on the order of 3 to 5 mm. The reinforcement threads in the blanket of the invention are nevertheless completely embedded within the layer of elastomeric material. This is important in order to avoid possible wearing of the reinforcement threads from outside the press blanket. Particularly favorable results can be obtained if not only the circumferential threads, but also the longitudinal threads, have extremely small thread diameters. It is even possible to use longitudinal threads having diameters which are even smaller than the diameter of the circumferential threads.

Press blankets of the above indicated slight thickness have already been used in paper manufacturing machines. However, these press blankets have woven and therefore stiffening reinforcement inserts. In that case, the outer threads of the weave protrude out of the elastomeric blanket material and the threads are therefore subject to wear.

EP 0 354 743 A1 discloses a press blanket which has ribs which extend in the circumferential direction with grooves present between the ribs. In that case, one circumferential thread or two circumferential threads of, for instance, a diameter of 0.5 mm lie in each rib. Due to the generally very slight width of the ribs, which may be on the order of magnitude of 2 mm, it appears doubtful that during the manufacture of the press blanket, the circumferential threads can be placed with the necessary accuracy in the ribs, without the threads also extending, at least at individual places, into the grooves.

In another essential concept of the invention, the tensile strength of all of the circumferential threads is higher, preferably at least 40% higher, referred to a unit area of the press blanket, than the tensile strength of all longitudinal threads. Despite the extremely small diameter of the circumferential threads, the press blanket has the necessary tensile strength in the circumferential direction. When the same or similar materials are used for both of the longitudinal and circumferential threads, the sum of all thread cross-sections is made substantially greater in the circumferential direction than in the longitudinal direction, referred to any unit area. This can mean that when threads of the same thickness are used, the number of circumferential threads is greater than the number of longitudinal threads, again referred to a unit area of the press blanket. As an alternative for or in addition to these measures, the circumferential threads can consist of a material of greater tensile strength, for instance, carbon fibers, than the longitudinal threads, which, for instance, may consist, as previously, of a polyamide.

In a tubular press blanket which is closed at both ends, the thread diameter of the circumferential threads should amount to only about 1/4000 to 1/1000 and, in special cases, up to 1/500, of the outside diameter of the press blanket. On the other hand, if the press blanket is to be used as a press belt tube which is open on the side, according to FIG. 5 of U.S. Pat. No. 4,552,620, then the thread diameter of the circumferential threads should be between 1/8000 to 1/2000 of an imaginary belt diameter, for instance, the outside diameter of the pouring cylinder necessary for the manufacture of the press blanket.

Shaping of a press blanket according to the invention should provide a substantially longer blanket life. This results not only of its increased flexural softness, but also from the fact that, as a result of the smaller thickness of the press blanket, the stressing of the blanket by shear forces, upon its introduction into the press zone, is substantially reduced. Furthermore, the flexing stress is decreased. As as a result, the danger that the bond between the reinforcement threads and the layer of elastomeric material will loosen is eliminated, or at least it is substantially reduced. This danger can also be reduced by the use of multi-filament threads (instead of mono-filament threads) or by the use of mono-filament threads that have sections which are pressed flat, as in FIGS. 4*a* and 4*b* of WO 88/08897.

The press blanket of the invention is manufactured predominantly in the manner set forth in International Application WO 88/08897, which corresponds to U.S. application Ser. No. 299,829 and Canadian Application No. 570,468. In particular, the means for clamping the longitudinal threads on, and particularly above the surface of, a pouring cylinder are described in detail therein. Such description is incorporated herein by reference.

An apparatus for forming such a press blanket includes a rotatable pouring cylinder on which the longitudinal threads are supported, an elastomeric material pouring nozzle which moves longitudinally over the pouring cylinder and an unwinding device for delivering the circumferential thread in a helical manner, wherein the nozzle is located just after the pouring nozzle above the pouring cylinder.

Other objects and features of the invention and some details of the apparatus for the manufacturing the press blanket are explained below with reference to the accompanying drawings.

DESCRIPTION OF THE PREFERRED EMBODIMENT

Figure 1:
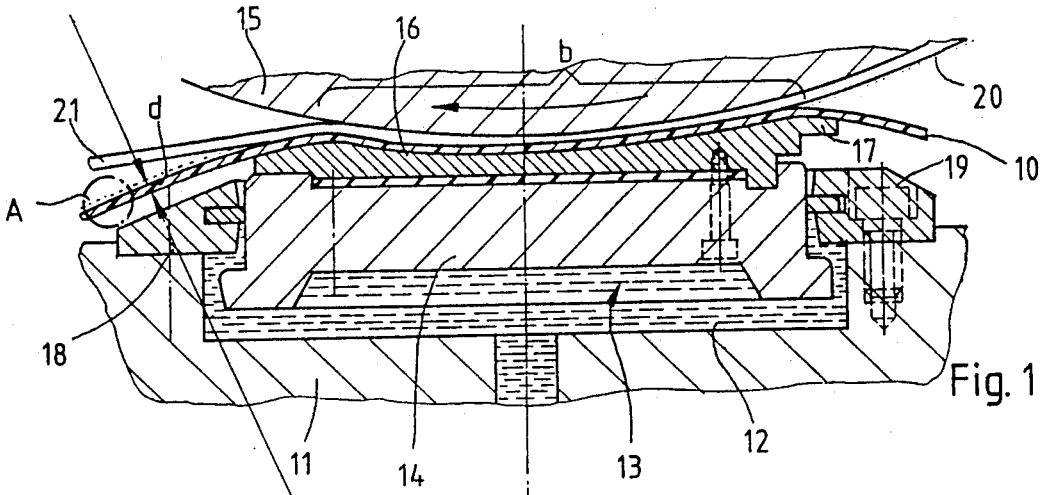
FIG. 1 is a partial cross section through a long nip paper making machine press having a press blanket in accordance with the invention.

Essential elements of a known long nip press of the press section of a paper making machine are shown in FIG. 1. There is a stationary support body 11, of which only a small part is visible. The body 11 supports a multi-part press shoe 13, which is displaceable radially, parallel to a press plane E. A supported counter roll 15 opposes the press shoe and defines the long press pip. The press shoe 13 is divided into a lower supporting part 14 and an upper pressing part 16. The lower part 14 is in the form of a piston in a pressure chamber 12. That chamber 12 is developed as a recess in the support body 11. The chamber is limited by sealing ledges which rest in sealing ledge supports 18 and 19. The upper part 16 of the press shoe has a predominantly concave upper slide surface which is mostly adapted to the curved peripheral shape of the counter roll 15. A press blanket 10 slides over that surface of the press shoe. The press shoe upper part 16, together with the counterroll 15, forms a so-called long or wide press nip, which has the length b in the direction of blanket and web travel, as indicated by an arrow. In addition to the press blanket 10, a dewatering felt band 21 passes through the press nip. Furthermore, a paper web 20 passes between the press blanket 10 and the felt band 21, as is indicated by a dotted line.

Outside the press nip, the tubular press blanket 10 travels on a substantially circular circumferential path. The path has a center 9*a* and a radius R. The axis of rotation 9*a* of the press blanket 10 is offset with respect to the center axis 7*a* of the stationary support member 11. At the entrance to the press nip, the press shoe upper part 16 has an extension 17 which forms a rounded transition from the circular circumferential path of the press blanket to the concave part of the slide surface. A somewhat similar rounded transition is provided at the outlet from the press nip.

The thickness d of the press blanket 10 is approximately on the order of magnitude of 3 to 5 mm. The outside diameter of the press blanket, i.e., twice the sum of the radius R plus the blanket thickness d, is, for instance, on the order of magnitude of 1.5 m. In a special case, it may be less than 1.0 m.

Figure 7:
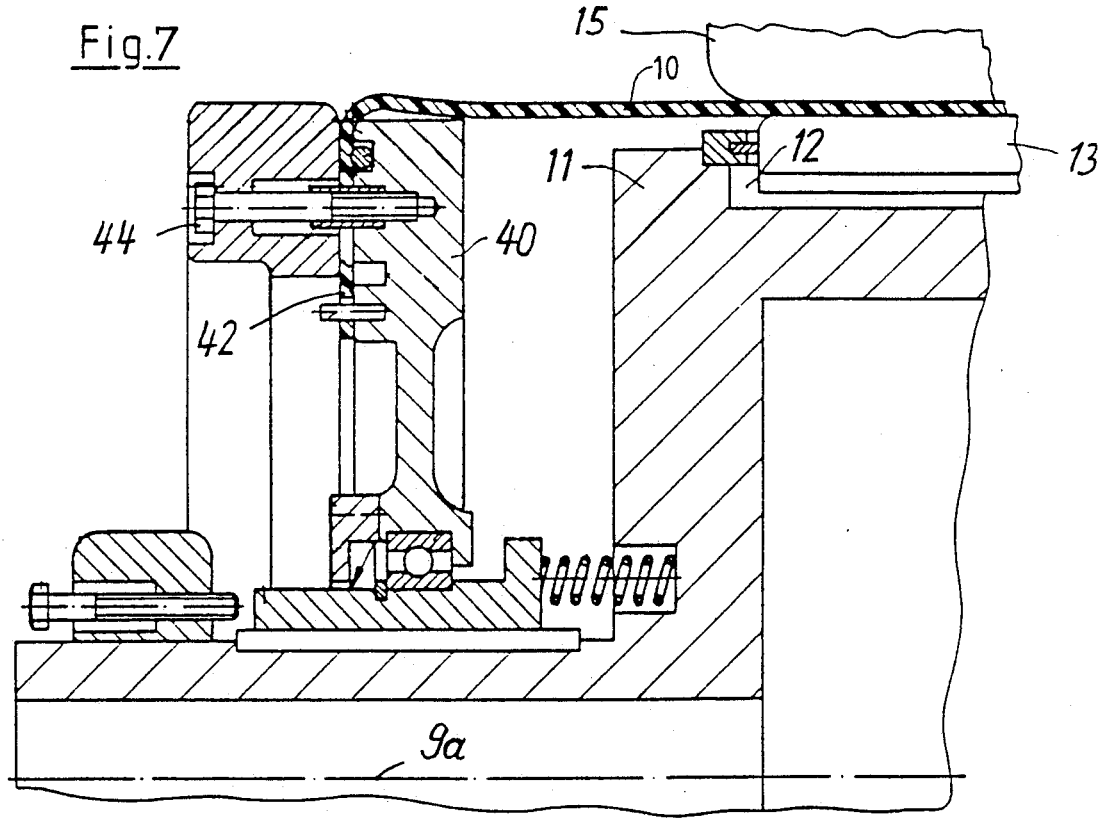
FIG. 7 is a fragmentary longitudinal sectional view of a lateral end of a long nip press similar to that shown in FIG. 1.

Blanket support disks 40, to which the two axial or lateral ends 42 of the press blanket 10 are fastened by bolts 44 or other fasteners and which are mounted for rotation around the axis of rotation 9*a*, are shown in FIG. 7. Such disks and their attachment to a press blanket are known from U.S. Pat. No. 4,944,089, incorporated herein by reference.

Figure 2:
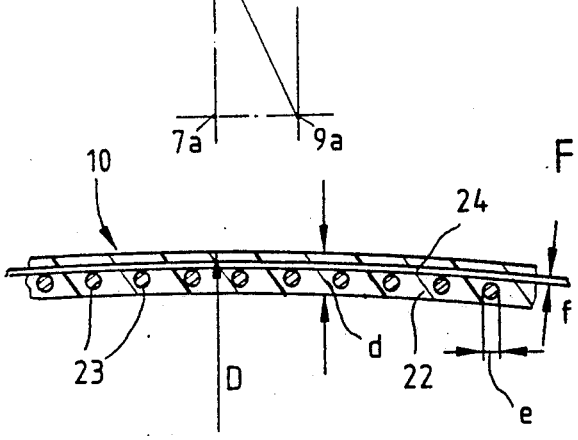
FIG. 2 is an enlarged detail A of FIG. 1.

FIG. 2 shows a greatly enlarged portion of the press blanket 10 at detail A of FIG. 1. It is comprised of elastomeric blanket material 22, for instance, polyurethane, and of the reinforcement threads 23 and 24 which are completely embedded in the blanket material. These comprise the longitudinal or axial threads 23, which extend parallel to the axis of rotation 9a, and the circumferential threads 24, which form the outer layer of threads and therefore are wound outside the inner longitudinal threads 23. The diameter f of the circumferential threads 24 is only about 1/4000 to 1/1000 of and in a special case, up to 1/500 of the outside diameter D of the press blanket 10. Referred to FIG. 1, $D=2(R+d)$.

Figure 3:
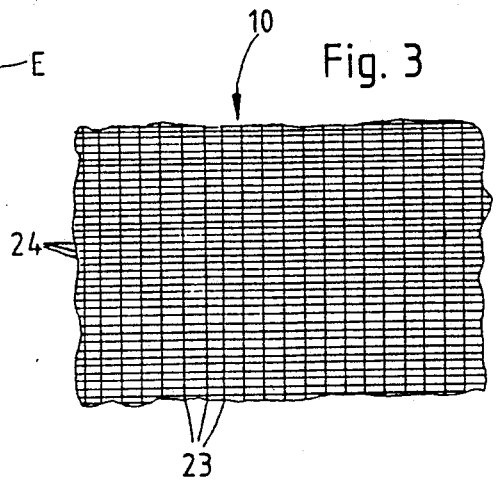
FIG. 3 is a schematic view of a piece of a press blanket with the reinforcement threads present therein.

FIG. 3 shows that the number of circumferential threads 24 in any particular unit area is substantially greater than the number of longitudinal threads 23 there. For example, the number of circumferential threads 24 can be three times greater than the number of longitudinal threads 23. This assumes that the diameter e of the longitudinal threads 23 is of the same order of magnitude as the diameter f of the circumferential threads 24 and that the same or similar materials are used for forming the longitudinal and circumferential threads.

In another embodiment, the following approximate thread dimensions can be used. Diameter e of the longitudinal threads 23 is on the order of magnitude of 0.5 mm. Diameter f of the circumferential threads 24 is on the order of magnitude of 1.0 mm. The thickness d of the press blanket is between 3 and 4 mm. The number of circumferential threads 24 in a particular unit area, is only about 1.2 to 2.0 times greater than the number of longitudinal threads 23.

Figure 4:
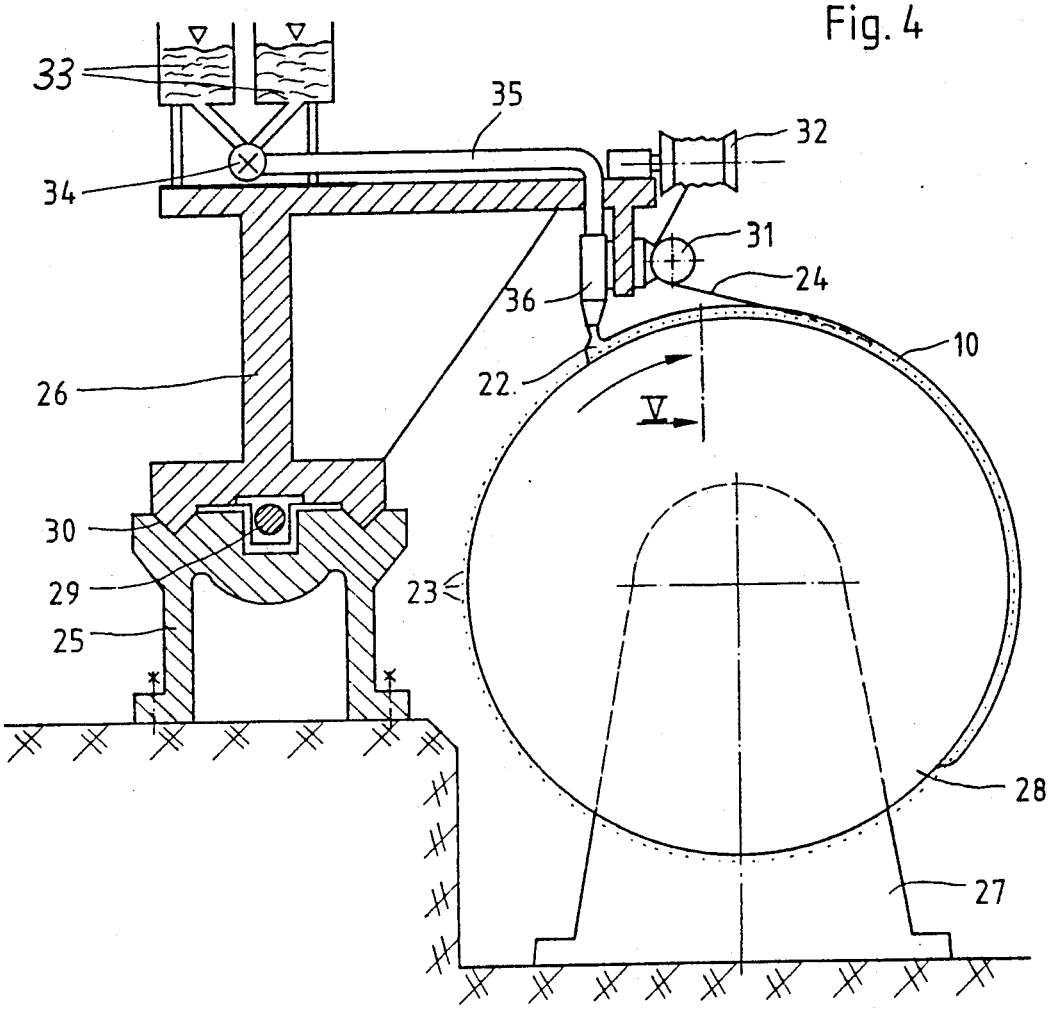
FIG. 4 diagrammatically shows a cross section through an apparatus for the manufacture of a press blanket.

An apparatus for manufacturing a press blanket 10 is shown in FIG. 4. It includes a stationary machine table 25, a support 26 which is translatable lengthwise or across the belt width on the table 25, and a pouring or belt forming cylinder 28, which is rotatably supported in bearing brackets 27. A drive (not shown) is provided for rotating the cylinder 28. The cylinder drive is coupled with a rotatable spindle 29 which also moves the support 26 in guide rails 30. This coordinates the speed of rotation of the pouring cylinder 28 with the speed of travel of the support 26 over the table 25.

The support 26 carries storage reservoirs 33 for the liquid components which form elastomeric blanket material when they are mixed. The support carries a liquid mixer 34, a feed line 35 leading away from the mixer and an outlet pouring nozzle 36. The mouth of the nozzle is located directly in the vicinity of the surface of the pouring cylinder 28. An unwinding device 32 for the circumferential threads 24 is also fastened on the support 26. The unwinding device 32 is arranged behind or after the pouring nozzle 36 with respect to the direction of rotation of the pouring cylinder 28, which is indicated by an arrow.

Figure 5:
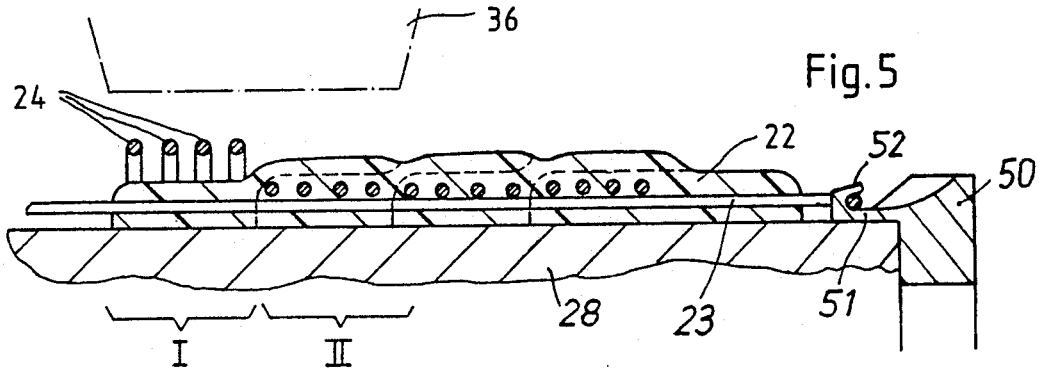
FIG. 5 is an enlarged partial longitudinal section along the line V of FIG. 4.

FIG. 4 diagrammatically shows numerous longitudinal threads 23 which are oriented approximately parallel to the axis of rotation of the pouring cylinder 28 and are supported by end supports on the lateral ends of the cylinder, e.g. as in International Application No. WO 88/08897, at a slight distance out from the outer surface of the cylinder. As described in that application and as shown in FIG. 5 hereof, all of the longitudinal threads 23 are held above the pouring cylinder 28, for example, by extending between tensioning rings 50 placed at opposite axial ends of the cylinder 28. Each of the rings 50 comprises a packing collar shaped ring 51 which has a plurality of radial, hook shaped projections 52 over its entire periphery. The circumferential placement of the projections 52 determines the circumferential spacing between the longitudinal yarns 23, and the placement of the hook shaped projections 52 also determines the height of the threads 23 over the surface of the pouring cylinder 28. Although individual longitudinal threads may be used, an alternative is to provide a continuous meandering thread which extends from one projection 52 on one ring 50 to a corresponding projection on the other ring and then back again, in meandering fashion, creating the series of longitudinal threads 23.

The elastomeric blanket material 22 is poured from the nozzle 36 onto the pouring cylinder 28, in the form of a helical bead that passes through the spaces between the longitudinal threads 23. At the smallest possible distance after the pouring nozzle 36, the circumferential threads 24 travel over a guide roller 31 and are directed into the body of the blanket material 22 which has just been cast on.

In FIG. 5, four adjacent circumferential threads 24 are, for instance, being wound on the cylinder 28 simultaneously. In the example shown, the circumferential threads 24 initially extend only slightly into the blanket material. Therefore, after one revolution of the pouring cylinder 28 (with the then applied elastomeric material indicated by dashed lines), further blanket material is poured onto the circumferential threads through the pouring nozzle 36.

The width, as seen in the circumferential direction of FIG. 5, of the outlet from the nozzle 36 is approximately twice as great as the advance of the support 26 in the cross belt direction upon one revolution of the pouring cylinder 28. In FIG. 5, the pouring nozzle 36 covers both the region (I) of one circumferential thread winding, comprising, for instance, four threads, which is wound directly behind the pouring nozzle, and also again covers the region (II) of the preceding circumferential thread winding also comprising four threads. If necessary, the width of the pouring nozzle can be increased even further so that it covers, for instance, the regions of three or four of the circumferential thread windings. As a result, in each case, relatively thin layers of elastomeric material overlap each other. On the other hand, if relatively complete thick "beads" of material were simply poured alongside of each other, there would be the danger that still liquid material would drip off from the pouring cylinder 8.

When a press blanket has been completely poured and hardened, its surface is smoothed by mechanical working and the desired thickness of the press blanket is thus produced. Differing from FIGS. 2 and 5, a press blanket having a greater thickness d can be produced by pouring on a larger amount of elastomeric blanket material. In this case, circumferential grooves and/or blind holes can be incorporated in the outer surface of the press blanket, if necessary, for temporary storage of press water in the press nip.

A particular advantage of the press blanket 10 of the invention is its greater "flexural softness" as compared with blankets in the prior art. In cases of blanket use in which this softness property is of less importance, two layers of circumferential threads can, for instance, be wrapped in the elastomeric blanket material upon the manufacture of the press blanket. The thickness of the finished press blanket will be increased accordingly.

Figure 6:
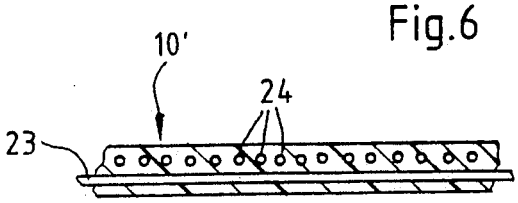
FIG. 6 is a partial longitudinal section through another embodiment of the press blanket of the invention.

Another possibility is shown in FIG. 6. In this press blanket 10', a certain distance through the thickness of the blanket has intentionally been provided between the circumferential threads 24 and the longitudinal threads 23, for instance on the order of magnitude of the thread diameter. This shifts the circumferential threads 24 into the vicinity of the outer surface, with only a slight increase in the thickness of the press blanket 10'. In this way, the elongation of the blanket upon its passage through the press nip can be reduced even further, particularly in the outer layer of the press blanket.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A press blanket for a press device, which device is for removing water from and/or smoothing of a web of material;

the press blanket comprising:

a generally tubular shape layer of elastomeric blanket material;

a radially inner layer of reinforcement threads contained within the layer of elastomeric blanket material and comprising longitudinal threads which extend parallel to the longitudinal axis of the tubular press blanket;

a radially outer layer of reinforcement threads contained within the layer of elastomeric blanket material and comprising circumferential threads which extend generally circumferentially around the tubular press blanket approximately in the direction of travel of the press blanket through the press device;

the reinforcement threads being embedded in the layer of elastomeric material, and the layer surrounding the reinforcement threads on all sides;

within any selected area of the press blanket, the tensile strength of all of the circumferential threads being greater than the tensile strength of all of the longitudinal threads.

2. The press blanket of claim 1, wherein the circumferential threads have a diameter of at most 1/500 of the outside diameter of the press blanket when the press blanket is in a circular shape.

3. The press blanket of claim 2, wherein the press blanket has the shape of a tubular roll, and the circumferential threads have a diameter of about 1/4,000 to 1/500 of the outside diameter of the roll blanket.

4. The press blanket of claim 1, wherein the circumferential threads are wrapped helically and extend approximately in the direction of travel of the press blanket.

5. The press blanket of claim 1, wherein the layer of elastomeric material is formed homogeneously generally from a single pouring.

6. The press blanket of claim 1, wherein within any unit area of the press blanket, the sum of all thread cross-sections of the circumferential threads is greater than the sum of all thread cross-sections of the longitudinal threads.

7. The press blanket of claim 1, further comprising blanket support disks at the end of the roll blanket which aid in causing a tubular shape for the roll blanket.

8. The press blanket of claim 1, wherein the press blanket has the shape of an endless belt loop and the belt loop is opened at both axial ends, the circumferential threads having a diameter of between 1/8,000 to 1/2,000 of an imaginary belt outside diameter.

9. The press blanket of claim 5, wherein the total thickness of the press blanket is in the range of 3 to 5 mm.

10. The press blanket of claim 1, wherein the total thickness of the press blanket is in the range of 3 to 5 mm.

11. The press blanket of claim 1, wherein the tensile strength of all of the circumferential threads is at least 40% higher than the tensile strength of all of the longitudinal threads.

12. The press blanket of claim 1, wherein there is a radial space inside the press blanket between the inner layer of longitudinal threads and the outer layer of circumferential threads and the radial space is equal to approximately the thread diameter.

* * * * *